US005809787A

United States Patent [19]

Zittel

[11] Patent Number: 5,809,787

[45] Date of Patent: Sep. 22, 1998

[54] METHOD OF COOLING POUCHED FOOD PRODUCT USING A COOLING CONVEYOR

[76] Inventor: David R. Zittel, 155 Oak Grove Dr., Columbus, Wis. 53925

[21] Appl. No.: 899,075

[22] Filed: Jul. 23, 1997

[51] Int. Cl.[6] ..... F25D 13/06

[52] U.S. Cl. ..... 62/63; 62/374; 62/380

[58] Field of Search ..... 62/63, 374, 380

[56] References Cited

U.S. PATENT DOCUMENTS

| | | | |
|---|---|---|---|
| 3,283,523 | 11/1966 | Long | 62/63 |
| 3,395,549 | 8/1968 | Grimes | 62/63 |
| 5,377,492 | 1/1995 | Robertson et al. . | |

OTHER PUBLICATIONS

"Heating, Ventilating, and Air–Conditioning Systems and Equipment," 1992 American Society of Heating, Refrigerating and Air–Conditioning Engineers, Inc. Handbook, Inch–Pound Edition.

"Refrigeration," 1994 American Society of Heating, Refrigerating and Air–Conditioning Engineers, Inc. Handbook, I–P Edition.

*Primary Examiner*—Ronald C. Capossela

*Attorney, Agent, or Firm*—Nilles & Nilles, S.C.

[57] ABSTRACT

A method of cooling food product in a flexible synthetic pouch to a temperature below 50° Fahrenheit using a coolant solution having a freezing point less than 32° Fahrenheit discharged from a plurality of orifices adjacent to pouched food product transported by a conveyor. The coolant preferably is a solution of brine or ethylene glycol cooled to a temperature less than 32° Fahrenheit and the pouch is constructed of a laminate sidewall having at least one layer of the laminate constructed of a material that becomes increasingly brittle as its temperature approaches and drops below 50° Fahrenheit making the pouch susceptible to fracture, pinholing or cracking if physically agitated, massaged or manipulated during cooling. In practicing the method of the invention, the brine or ethylene glycol coolant solution is cooled to a temperature below 32° Fahrenheit, typically between 32° Fahrenheit and minus 10° Fahrenheit, and discharged through the orifices onto pouches traveling on the conveyor. Coolant contacting the pouches cools the food product in the pouches to a temperature less than 50° Fahrenheit without requiring any physical agitation, massage or manipulation to cool the pouches to a temperature less than 50° Fahrenheit thereby preventing the integrity of the airtight seal and sidewall of the pouches from being compromised.

26 Claims, 6 Drawing Sheets

METHOD OF COOLING POUCHED FOOD PRODUCT USING A COOLING CONVEYOR

FIELD OF THE INVENTION

The present invention relates to a method of cooling pouched food product and more particularly to a method of cooling food product in flexible sealed pouches using a cooling conveyor which utilizes coolant having a freezing point below 32° Fahrenheit.

BACKGROUND OF THE INVENTION

Many food products, such as soups, sauces, pasta, vegetables, juices, fruits, and meats are often packaged in pouches before processing them by first heating them and thereafter by cooling them in preparation to be shipped for sale or storage. Each pouch is constructed of a flexible synthetic material that typically is a laminate having at least one layer constructed of a material, such as nylon, a polyethylene like low linear density polyethylene (LLDPE), polypropylene, polyethylene terephalate (PET), ethylene vinyl acetate (EVA), polyvinyl chloride (PVDC), a copolymer film, or oriented polypropylene (OPP), or another sidewall laminate material that becomes increasingly more brittle as it gets colder. Each pouch typically holds as little as a few ounces of food product but can hold as much as ten pounds of food product.

During heating of the pouches, the pouches are immersed in a liquid having a temperature of at least about 160° and as high as 212°. Typically, the pouches are heated in a blancher, such as the blancher disclosed in U.S. Pat. No. 5,429,041, which has an elongate tank filled with heated liquid, typically water, through which the pouches travel.

After heating, the pouches are cooled in another liquid having a temperature between than about 75° and about 30°. Typically, cooling takes place in a chiller filled with cold water, glycol or brine, having a temperature within this temperature range. During operation of the chiller, an elongate helical auger is rotated within a long tank of this cooled liquid to urge the pouched food product floating and immersed in the liquid from the inlet end of the tank toward the tank outlet end. To increase the rate of cooling of the pouched food product, agitating baffles, like those disclosed in U.S. Pat. No. 5,632,195, can be disposed between adjacent flights of the auger, to contact, lift, tumble, and agitate the pouches.

While it is highly desirable to cool the food product as close to freezing as possible so the food product can be quickly frozen for shipment or storage, cooling pouches below 50° is difficult because the pouches become increasingly brittle around and below this temperature. As a result, contact with any moving object that is hard or somewhat sharp, such as metal auger flights and baffles of a chiller, can crack or burst pouches, or cause small pinholes to form in them particularly at their end where they are heat sealed, any of which can cause the contents of a pouch to leak or coolant to migrate into the pouch contaminating the pouch. Either way, a pouch whose integrity has been compromised in this manner cannot be used and must be disposed of along with the food product within thereby, undesirably significantly increasing food processing costs and reducing efficiency. If food product has leaked out into the coolant, the coolant's efficiency can decrease and the coolant may later require costly wastewater treatment before disposal.

While cooling conveyors which spray or shower cool water on pouched food product are known in the art, they cannot cool food product to temperatures below about 50° Fahrenheit using cold water without having to agitate, massage or otherwise physically manipulate each pouch, all of which increases the likelihood and risk of compromising pouch integrity as the pouch becomes increasingly colder and more brittle. These pouch cooling limitations exist primarily because the water used to cool pouched food product cannot be cooled beyond its freezing point of 32° Fahrenheit, thereby limiting the capacity of the cold water to absorb heat from the pouched food product.

What is needed is a method of cooling pouched food product using a cooling conveyor without disturbing the pouch as it becomes more brittle during cooling. Thus, what is needed is a method of cooling pouched food product below 50° Fahrenheit without requiring the pouches to be agitated or otherwise be relatively violently contacted by any moving object. What is further needed is the use of a coolant in such a method which provides the capacity of absorbing sufficient heat from food product in pouches so as to cool the food product below 50° Fahrenheit without requiring agitation, massaging or any other type of physical manipulation.

SUMMARY OF THE INVENTION

A method of cooling food product contained in pouches constructed of a flexible, synthetic laminate that becomes increasingly brittle as its temperature drops below 50° Fahrenheit without compromising the integrity of the pouch seal or pouch sidewall during cooling. The cooling method involves showering or immersing pouched food product traveling along a conveyor with a liquid coolant having a freezing point below 32° Fahrenheit for cooling food product within the pouches to a temperature below 50° Fahrenheit without requiring the pouched food product to be agitated, massaged, tumbled or otherwise be physically manipulated. Preferably, the cooling method involves showering or spraying cooled ethylene glycol or brine having a temperature below about 30° Fahrenheit on the pouched food product as it travels along the conveyor.

The conveyor has an endless flexible belt assembly carried on rotatable spindles journalled to a frame resting on legs supported by the ground. Carried by the frame is a rack containing a plurality of spaced apart coolant delivery orifices which extend along the conveyor and shower the pouches on the belt with coolant as they travel along the conveyor. One or more of the orifices preferably are nozzles constructed and arranged to spray coolant under pressure in a relatively large area spray pattern, preferably in an inverted cone-shaped spray pattern, to increase the amount of surface area of the conveyor showered by coolant to thereby ensure that each pouch is virtually constantly showered with coolant the entire length of its travel along the conveyor to help maximize food product cooling.

The coolant used to cool the food product sealed in the pouches is a coolant having a freezing point below 32° Fahrenheit for improving cooling efficiency by being able to absorb a greater amount of heat from pouched food product. Although the coolant can contain water, it also contains some other ingredient which lowers the freezing point below 32° Fahrenheit to increase the capacity of the coolant to cool pouched food product thereby enabling the coolant to cool pouched food product to a temperature 50° Fahrenheit without requiring the pouches to be agitated, physically massaged, or otherwise physically manipulated to increase cooling. As a result, a cooling conveyor using a solution having these cooling or heat absorbing characteristics is capable of cooling food product to a temperature as low as about 33° Fahrenheit and typically between about 35° Fahrenheit and about 45° Fahrenheit without compromising the integrity of any pouch. While the method of this invention does not employ violent agitation, massage or other physical manipulation to facilitate cooling, it can employ gentle agitation, such as by gently flipping each pouch over while it is traveling along the conveyor to expose its opposite side to coolant.

One preferred coolant is a solution containing ethylene glycol ("glycol"). Another preferred coolant is a brine solution. If the coolant is a brine solution, a salt is used to lower the freezing point of the brine solution. Preferably, the salt used to make the brine solution is sodium chloride, but can be another freezing-point temperature lowering salt, such as calcium chloride which is advantageous because of its minimal environmental impact. Both glycol coolant and brine coolant are particularly well suited for cooling pouches because they are food grade, meaning they are safe for use in food processing applications.

After use, coolant from the conveyor preferably is collected and pumped to a coolant liquid chiller, preferably of conventional construction, where it is recooled for reuse. After recooling, the coolant is returned to the conduit where it is expelled under pressure from the coolant orifices onto pouches.

Each pouch is constructed of a sidewall of a flexible laminate material having at least one layer which becomes increasingly more brittle as its temperature approaches and drops below about 50° Fahrenheit such that the pouch is susceptible to crease fracture, bursting, pinholing or another mode of failure if physically massaged, agitated or otherwise physically manipulated. Typically, such pouches have at least one layer made of a laminate that is composed of nylon, polyethylene, polyethylene terephalate, polyvinyl chloride coated, polypropylene, ethylene vinyl acetate, and/or oriented polypropylene.

In practicing the method of the invention, pouches introduced onto the conveyor are showered with coolant having a freezing point less than 32° Fahrenheit. The coolant is expelled under pressure from the orifices onto the pouches as they move along the conveyor. Coolant is preferably showered onto the pouches substantially the entire length of the conveyor to maximize cooling. Preferably, coolant having a pressure of at least about ten pounds per square inch and/or a flow rate of at least about three gallons per minute is expelled from each orifice to forcefully impact against each pouch to help maximize cooling by preventing any boundary layer of coolant from forming on the exterior of any pouch. Preferably, pouches enter the conveyor having a food product temperature of between about 45° Fahrenheit and about 60° Fahrenheit and exit the conveyor having a food product temperature less than the food product temperature entering the conveyor and in any event less than 50° Fahrenheit. Preferably, the temperature of food product exiting the conveyor is between about 45° Fahrenheit and about 35° Fahrenheit, enabling the food product to be quickly and easily frozen, if desired.

Objects, features and advantages of this invention are to provide a method of cooling pouched food product below 50° Fahrenheit which uses a cooling conveyor to efficiently cool pouched food product while advantageously preserving the integrity of the seal and sidewall of each pouch containing the food product thereby increasing food processing efficiency; uses a coolant that is safe for use on food products; is economical in that coolant can be recooled, recycled and reused minimizing and virtually eliminating wastewater treatment and costs associated with such treatment; is efficient and effective at preventing pouch damage; and is practiced using a conveyor that is rugged, simple, flexible, reliable, and durable, and which is of economical manufacture and which is easy to make, assemble and use.

BRIEF DESCRIPTION OF THE DRAWINGS

These and other objects, features, and advantages of this invention will become apparent from the following detailed description of the best mode, appended claims, and accompanying drawings in which:

and

Figure 11:
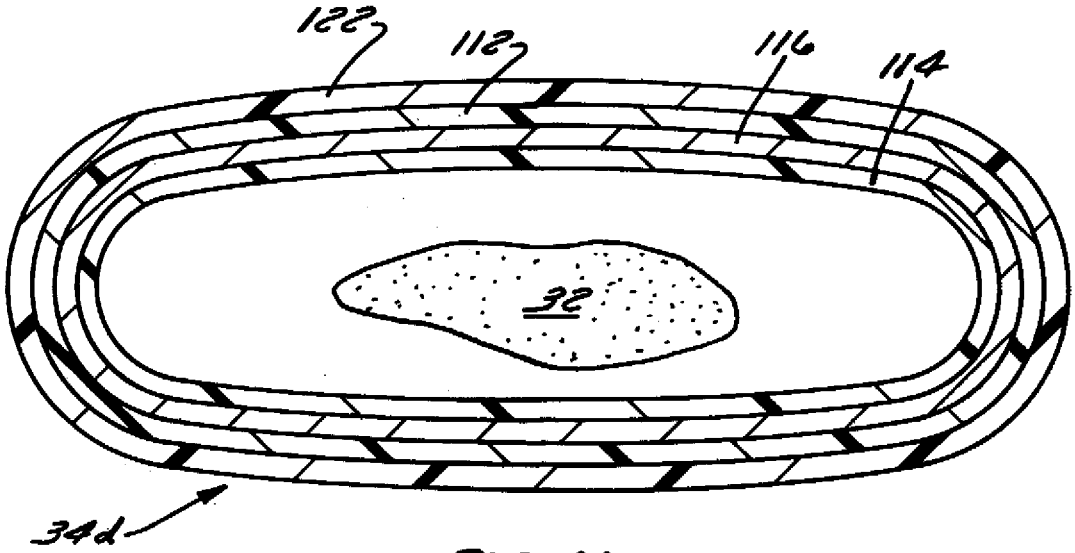

FIG. 11 is an enlarged cross sectional view of a still another pouch embodiment.

DETAILED DESCRIPTION OF THE INVENTION

Figure 1:
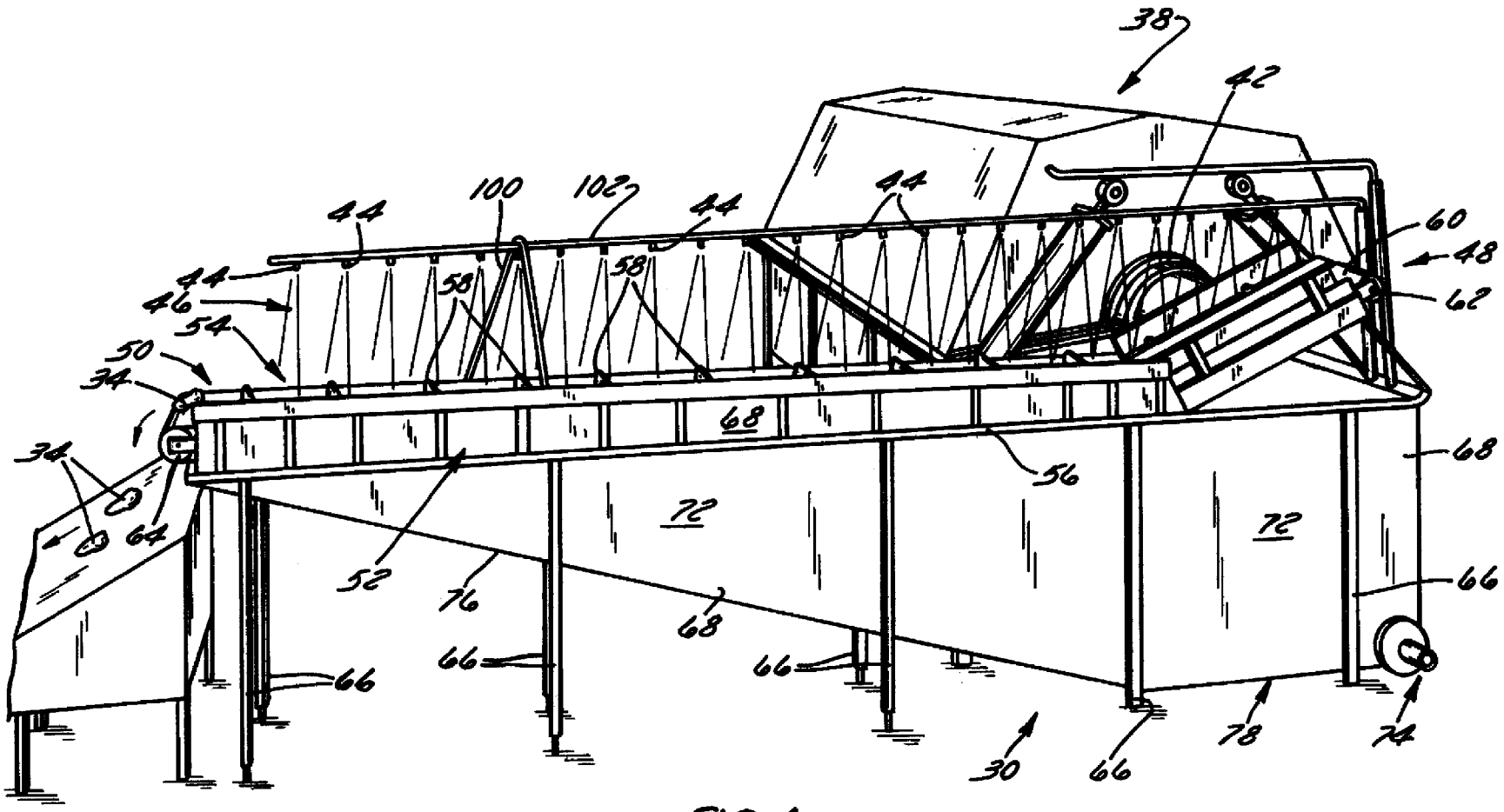
FIG. 1 is a perspective side view of a food processing apparatus and cooling conveyor of the invention with the inlet end of the conveyor upraised and beside the discharge outlet of the apparatus and its outlet end delivering cooled pouched food product onto a chute or into a bin.

FIGS. 1–6 illustrate a conveyor 30 of this invention for practicing a novel method of cooling food product 32 (in phantom in FIG. 7) received in flexible pouches 34, such as those depicted in FIGS. 7–11, that are constructed of a flexible laminate sidewall 36 having at least one layer of a synthetic, plastic or elastomeric material and/or a seal 40 which become increasingly brittle as the pouch temperature approaches and becomes less than 50° Fahrenheit. As is shown in FIG. 1, the conveyor 30 is located next to a food processing apparatus 38, such as a food product chiller, such as is disclosed in U.S. Pat. No. 4,875,344 to Zittel, a food product blancher, such as is disclosed in U.S. Pat. No. 5,429,041 to Zittel, or another type of food processing apparatus, to receive pouches 34 as they are expelled from a discharge outlet 42 of the apparatus 38 to transport the pouches to a location away from the apparatus 38 while cooling them to lower their temperature below 50° Fahrenheit in a manner that will not fracture, crack or pinhole any pouch 34 or otherwise compromise the integrity of the seal 40 or sidewall 36 of any pouch 34. To cool the pouches 34 and food product 32 inside each pouch 34, the conveyor 30 includes a plurality of spaced apart orifices 44 in relatively close proximity to the pouches 34 which deliver liquid coolant 46 onto the pouches 34. Preferably, the coolant 46 is a solution of a food grade material, preferably glycol or brine, which is dripped, showered, sprayed, misted, cascaded or deluged onto the pouched food product 32 by the orifices 44 and which has a freezing point below 32° Fahrenheit so it can cool the pouched food product 32 below 50° Fahrenheit. By using a coolant 46 having these characteristics in combination with a conveyor 30 of this construction, a novel method of this invention is practiced whereby the food product 32 is cooled below 50° Fahrenheit without needing to agitate, massage or otherwise physically manipulate the pouches 34 thereby preventing them from being damaged. As a result of preventing pouch damage, the efficiency of cooling food product 32 is increased while coolant filtration and treatment costs due to leaking pouches are significantly reduced and preferably virtually completely eliminated.

Figure 2:
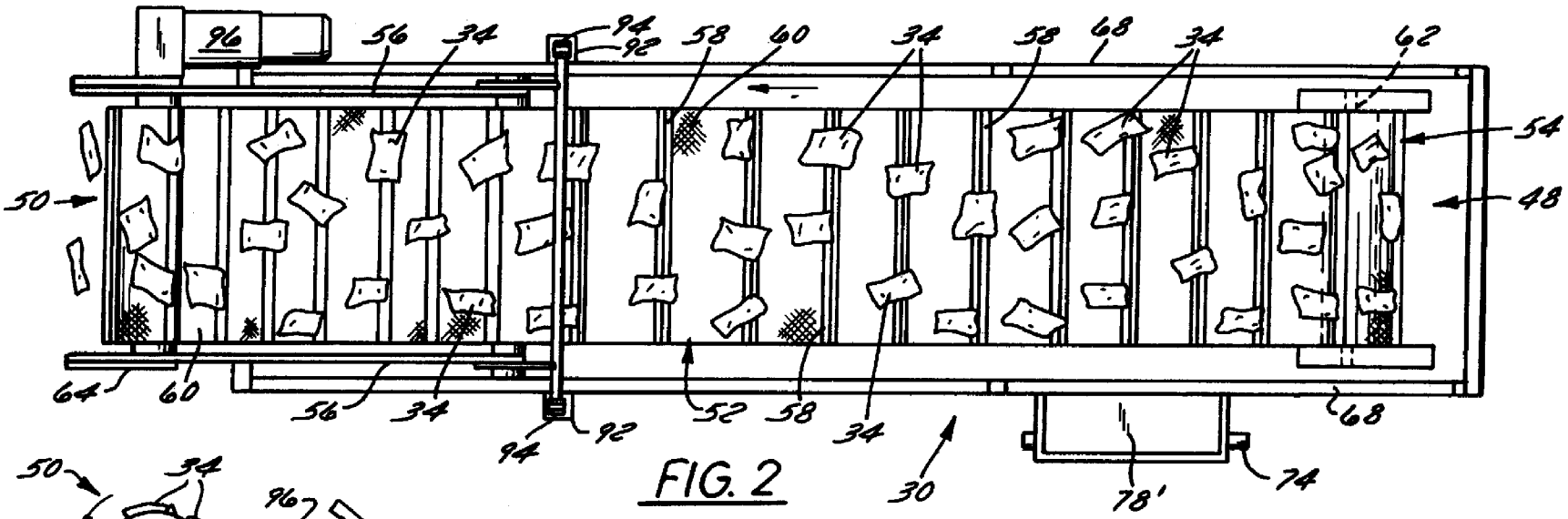
FIG. 2 is a top view of the cooling conveyor having its outlet end tipped upwardly.
Figure 3:
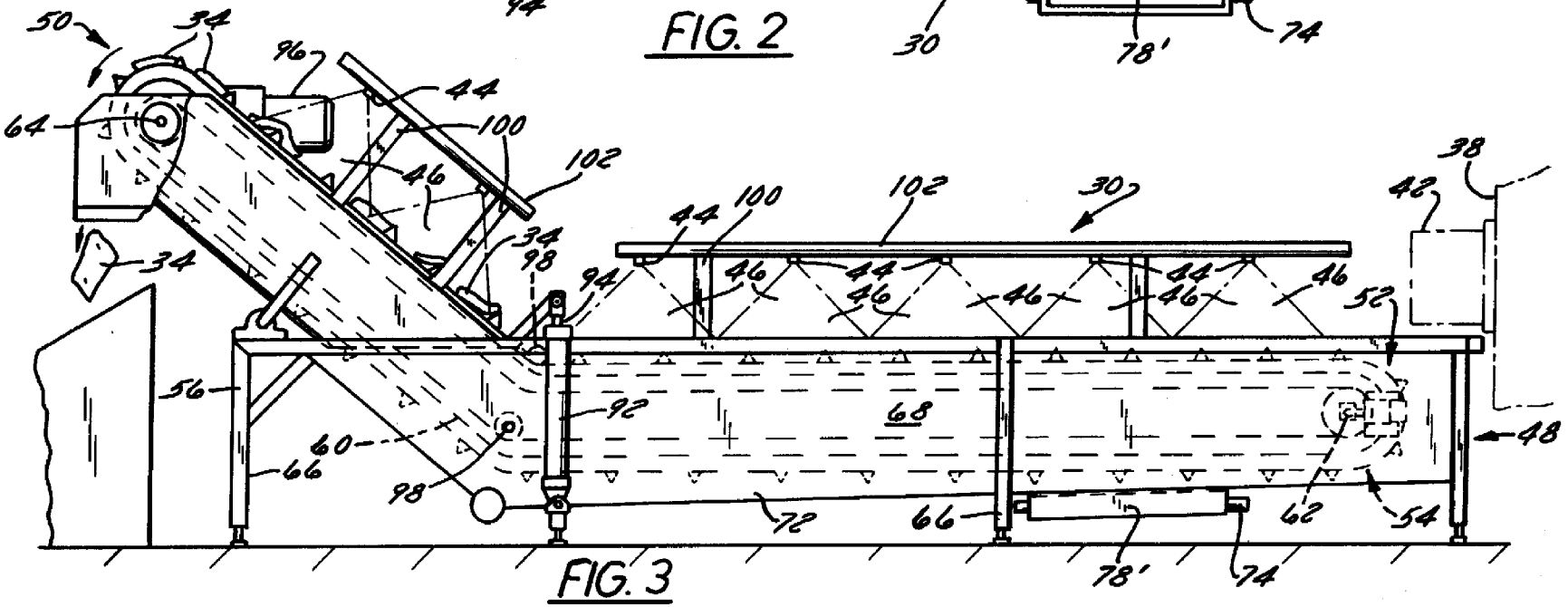
FIG. 3 is a side view of the conveyor depicting pouched food product from its upwardly extending discharge end being deposited onto a chute or slide.

Referring to FIG. 1, the conveyor 30 has an inlet end 48 adjacent the outlet 42 of the food processing apparatus 38 for receiving pouches 34 expelled from the apparatus 38 and an outlet end 50 downstream of its inlet end 48. Referring additionally to FIGS. 2 and 3, the conveyor 30 has a bed 52 into which the pouches 34 are received which is constructed and arranged to transport pouches 34 from adjacent the inlet end 48 toward the outlet end 50. The conveyor 30 includes a belt assembly 54 carried by a support frame 56 that is constructed and arranged to transport the pouches 34 along the conveyor 30. The belt assembly 54 includes a plurality of spaced apart slats 58 that move relative to the conveyor frame 56 and which are upraised to each urge, if necessary, one or more pouches 34 along the conveyor 30. In a preferred embodiment, the belt assembly 54 is an endless flexible belt 60 carried on rollers or sprockets 62, 64 rotatively journalled to the frame 56, with the frame having legs 66 that rest upon the ground. Each leg 66 preferably can be adjusted to at least slightly raise or lower the conveyor 30 relative to the ground. A pair of upstanding sidewalls 68 bracket the belt 60 oppose coolant 46 flow away from the bed 52 and belt 60 to cause coolant 46 to remain in contact with the pouches 34 an optimum period of time to help maximize food product cooling. The sidewalls 68 also help prevent coolant 46 from overflowing the conveyor 30 and running onto the ground, thereby preventing coolant loss during operation.

Preferably, the belt 60 is constructed of a plurality of generally flat panels 70 hingedly joined in seriatim to one another with each panel 70 equipped with an upraised slat portion 58. In another preferred belt embodiment, the spaced apart slats 58 form the belt and slide during operation along a flat, smooth bed to urge the pouches 34 along the conveyor 30. Preferably, the panels 70 and slats 58 are constructed of a nylon, a stainless steel, or another hygienic material that is safe for use with food product. Other belt assembly arrangements are contemplated by the conveyor 30 and method of this invention.

The belt 60 or bed 52 can be constructed with passages, gaps, holes or be of meshlike construction for permitting excess coolant 46 to drain below into a catch basin 72 carried by the frame 56. The size, number and density of these coolant conveyances can be determined through routine experimentation and testing to help optimize pouch contact with coolant 46, such as by optimizing contact with or immersion in coolant 46, to maximize and/or optimize the rate of pouch cooling. If desired, however, the spacing of the sidewalls 68 from the belt 60 or bed 52 can be selected to provide clearance for coolant 46 to flow between the sidewall 68 and outer edge of the belt 60 below to the basin 72.

Preferably, the catch basin 72 is integral with the frame 56 and is formed in part by sidewalls 68 extending downwardly below the conveyor belt 60 and a bottom wall 76 creating, in effect, a tank 72 capable of collecting liquid coolant 46. Preferably, the catch basin 72 has a sump area 78 which is lower than the rest of the basin 72 where used coolant 46 collected in the basin 72 can be easily and efficiently drained from the basin 72. In FIG. 1, the sump 78 is the lowest portion of the basin 72. In FIGS. 2 and 3, the sump 78' is a tank below the basin 72. The sump 78 has a drain port 74 from which used coolant 46 can be discharged for disposal or reuse.

Figure 6:
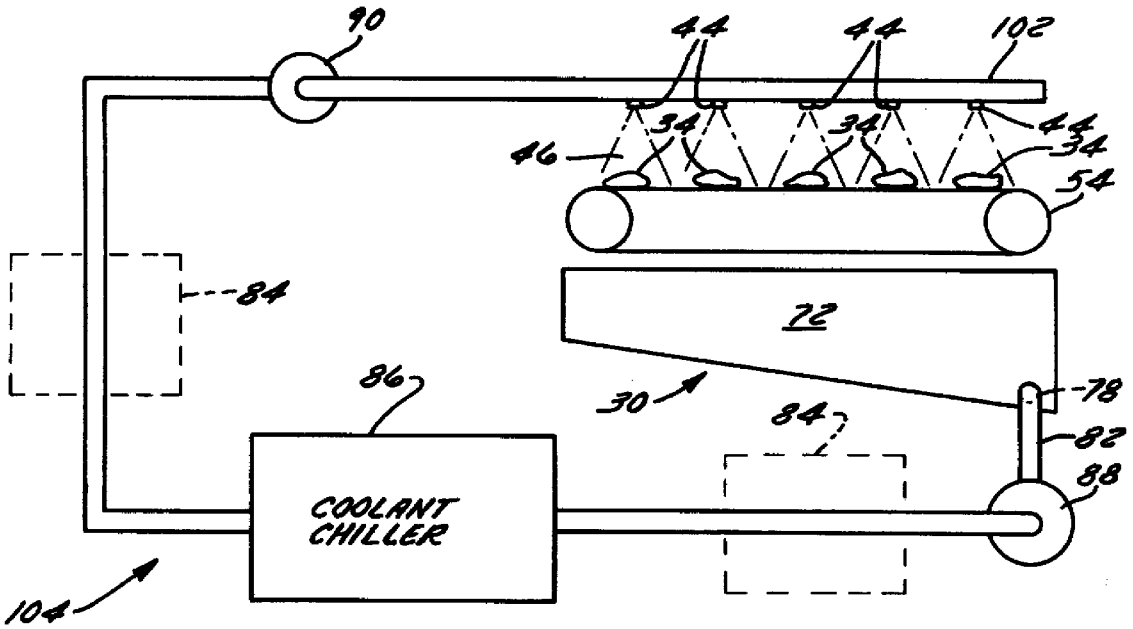
FIG. 6 is a simplified schematic diagram of a coolant recirculation system of the conveyor.

Referring additionally to FIG. 6, coolant 46 is discharged through the port 74 to a drain pipe 82 which communicates the coolant 46 to a collection tank 84 (in phantom in FIG. 6) or to a coolant chiller 86 where the coolant 46 is ultimately recooled so it can be reused. The collection tank 84 can be upstream or downstream of the coolant chiller 86. Preferably, a first pump 88 draws coolant 46 from the basin 72 and delivers the coolant 46 to the coolant chiller 86 and another pump 90 urges the cooled coolant 46 from the chiller 86 or collection tank 84 to the conveyor 30 for reuse.

The coolant chiller 86 preferably is a conventional chiller capable of cooling liquid coolant containing brine or ethylene glycol to a temperature of below 32° Fahrenheit. One suitable type of coolant chiller uses a conventional scroll, trochoidal, centrifugal, rotating screw, or reciprocating piston type compressor to compress a refrigerant, such as freon, ammonia or the like, that ultimately flows through hollow metal tubing or coils in contact with the coolant 46 to cool and recool the coolant 46. The construction and operation of such compressors is described in Chapter 35 of the 1992 ASHRAE Handbook entitled Compressors, pages 35.1–35.35, the disclosure of which is hereby expressly incorporated herein by reference. Another suitable type of coolant chiller is a conventional adsorption type chiller that uses ammonia as a refrigerant which flows through hollow tubing or coils in contact with the coolant 46, the disclosures of which are hereby expressly incorporated herein by reference. Suitable chilling systems and arrangements for cooling liquid, such as coolant 46, to the temperatures described herein are disclosed in Chapter 42 of the 1992 ASHRAE Handbook entitled Liquid Chilling Systems, pages 35.1–35.35, the disclosure of which is hereby expressly incorporated herein by reference.

Figure 5:
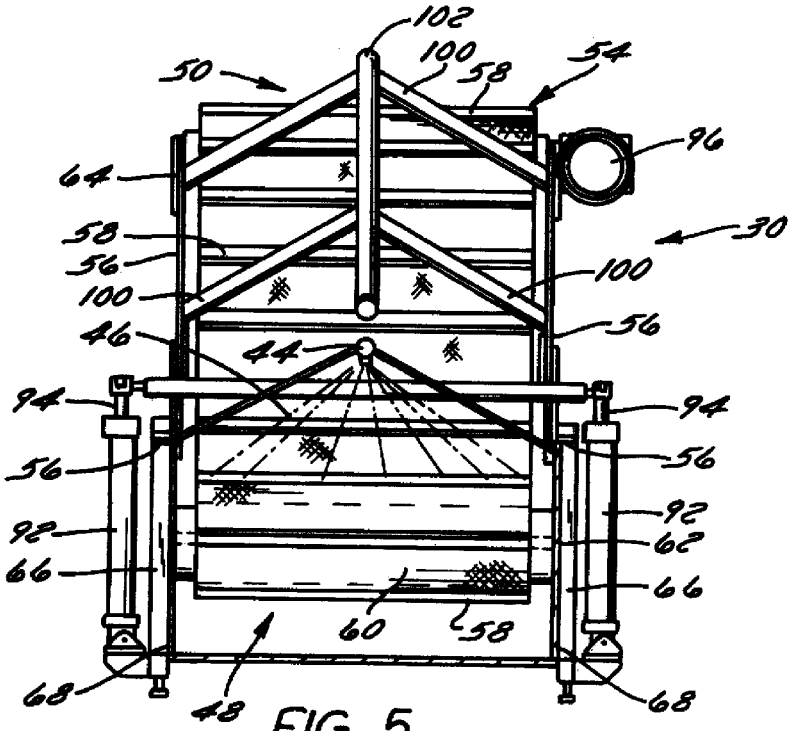
FIG. 5 is a front view of the conveyor.

In FIG. 1, the inlet end 48 of the conveyor 30 is upraised. In FIG. 3, the conveyor 30 is depicted with its outlet end 50 upraised. As is shown in FIGS. 2, 3, and 5, to adjust the angle of inclination of the conveyor 30 or a portion of the conveyor 30, such as for adjusting its inlet end 48 to receive pouches 34 discharged from a food processing apparatus 38 or changing the height at which it discharges pouches 34, the conveyor 30 can include a pair of cylinders or actuators 92 constructed and arranged to selectively raise or lower the inlet end 48 or the outlet end 50 of the conveyor 30 relative to the ground. In this manner, the conveyor 30 can be flexibly configured for a wide variety of applications and food processing factory layouts. Preferably, each actuator 74 comprises a pair of hydraulic or pneumatic cylinders 92 each having one end supported by the ground and a movable piston rod 94 at the other end secured to the frame 56 of the conveyor 30 that can be raised or lowered to raise or lower the frame 56 relative to the ground.

As is shown in FIG. 3, the sprocket or roller 64 at or adjacent one end of the conveyor 30 is driven by a prime mover 96 that preferably is an electric or hydraulic motor 96. At the opposite end of the conveyor 30, the belt 60 is carried by an idler sprocket 62. Adjacent where upraised and horizontal portions of the conveyor 30 converge there is at least one other idler sprocket 98 (FIG. 3) guiding the conveyor belt 60. Preferably there are upper and lower idler sprockets 98 guiding the belt 60 where the conveyor 30 makes such a convergence.

The orifices 44 are disposed in relatively close proximity to pouches 34 and the belt 60 such that coolant 46 flowing from the orifices 44 is directed onto the belt 60 and pouches 34 contacting the pouches 34 and cooling the food product 32 within. Preferably, the orifices 44 are located in the line of sight with the pouches 34 so that coolant 46 expelled under pressure from the orifices 44 showers pouches 34 on the belt 60. The conveyor 30 has a plurality of spaced apart orifices 44 carried by a conduit 102, attached to the frame 56 by a support rack 100, with the conduit 102 extending substantially the length of the conveyor 30 and the orifices 44 spaced apart along the conduit 102. Preferably, the conduit 102 is a manifold 102 for distributing coolant 46 to each of the orifices 44. Although the orifices 44 are arranged in a single row in the drawing figures, two or more rows of orifices 44 carried by two or more conduits 102 can be used. If desired, the orifices 44 can be staggered at different locations or angles to help produce a spray pattern that covers a pouch 34 from when it enters the conveyor 30 until it exits the conveyor 30.

As is shown in FIG. 1, the coolant conduit 102 and orifices 44 generally overlie the belt 60 and pouches 34. Preferably, at least some of the orifices 44 are nozzles 44 for causing coolant 46 expelled under pressure to spray onto pouches 34 with the spray pattern such that it increases and maximizes the surface area contacted by coolant 46. Preferably, all of the orifices 44 can be nozzles 46 for spraying coolant 46 onto the pouches 34 in a manner which helps cover a maximum of exposed pouch surface area helping to maximize cooling. Spraying the coolant 46 under pressure also helps to turbulently introduce coolant onto pouches 34 to further maximize cooling. Additionally, coolant 46 sprayed onto pouches 34 preferably results in at least some evaporative cooling helping to increase cooling of the food product 32 within each pouch 34.

To optimize cooling of the pouched food product 32, the rate of flow of coolant 46 sprayed onto the pouches 34 along with the rate of draining of the coolant 46 from the belt 60 and bed 52 of the conveyor 30 can be determined through routine experimentation and testing to optimize the amount of evaporative cooling, cooling by conduction, and cooling by convection of the pouches 34 and food product 32 that takes place to maximize the amount of food product cooling preferably using the shortest conveyor length. Preferably, a sufficient volume of coolant 46 under pressure is delivered to the conduit 102 such that coolant 46 exits each nozzle or orifice 44 at a pressure at least about ten pounds per square inch and/or a flow rate of at least about three gallons per minute. At this pressure and flow rate, an ethylene glycol coolant solution having at least 40% ethylene glycol by volume cooled to a temperature of less than 10° Fahrenheit is capable of cooling pouched food product to a temperature of 35° Fahrenheit or colder. At this pressure and flow rate, a brine coolant solution having at least 10% brine by weight cooled to a temperature of less than 27° Fahrenheit is capable of cooling pouched food product to a temperature of 45° Fahrenheit or colder.

Preferably, the construction and spacing of the nozzles 44, the pressure of coolant 46 delivered to the nozzles 44, and the distance the nozzles 44 are spaced from the belt 60 are selected to ensure that a single pouch 34 will be continuously showered with coolant 46. As is shown in FIG. 1, the nozzles 44 are preferably spaced apart approximately an equal distance from each other substantially the entire length of the conveyor 30 to ensure the pouches 34 will be continuously showered with coolant. While the nozzles 44 are shown generally overlying the pouches 34 and conveyor bed 52, the nozzles 44 can also be carried by the conveyor sidewalls 68 and directed generally transversely to or opposite the direction of travel of the pouches 34, if desired.

Referring to the schematic diagram shown in FIG. 6, the cooling conveyor 30 preferably further includes a coolant recirculation system 104 for minimizing loss and maximizing reuse of coolant 46. In operation of the system 104, the coolant 46 sprayed onto pouches 34 traveling along the conveyor 30 is collected in the basin 72 where it exits through the drain port 74 of the sump 78. The spent coolant 46 is drawn from the sump 78 by pump 88 and delivered to coolant chiller 86 where it is cooled. Thereafter, the cooled coolant 46 is pumped by pump 90 to the coolant conduit 102 where it is expelled from the nozzles 44 onto the pouches 34. During operation of the conveyor 30, coolant 46 preferably is continuously recirculated generally in this manner.

The coolant 46 is a liquid solution having a freezing point of less than 32° Fahrenheit to cool food product 32 within each pouch 34 to a temperature less than 50° Fahrenheit without needing to agitate any food product 32 or pouch 34 thereby preventing pouches 34 from being damaged by being cracked, pinholed, fractured or such that their sidewall 36 or seal 40 is compromised. Preferably, the coolant 46 is a solution containing ethylene glycol or brine, both of which result in a coolant 46 having a freezing temperature of below 32° Fahrenheit. If the coolant solution 46 contains ethylene glycol, it contains at least about 40% ethylene glycol by volume. If desired, the ethylene glycol solution can be formulated to contain between about 10% and about 50% ethylene glycol by weight with at least some of the remainder of the solution 46 comprised of water. Preferably, the ethylene glycol coolant solution is comprised of between 30% and 50% ethylene glycol by weight.

If an ethylene glycol coolant solution 46 is used, it is cooled to a temperature lower than 32° Fahrenheit and can be cooled to a temperature as low as minus 10° Fahrenheit. Typically, for most pouch cooling applications, it is anticipated that the ethylene glycol coolant solution 46 will be cooled to a temperature of between about 0° (zero degrees) Fahrenheit and about 27° Fahrenheit before being applied on pouches 34 on the conveyor 30 to cool food product 32 in the pouches 34 to a temperature below 50° Fahrenheit and as low as 32° Fahrenheit, or even lower, if desired. For applications where it is desired to cool food product 32 below 32° Fahrenheit, the ethylene glycol coolant solution 46 is cooled to a temperature of between 0° Fahrenheit and minus 10° Fahrenheit.

Where the coolant 46 is a brine solution, the solution 46 contains at least about 10% brine by weight. Preferably, the brine coolant solution 46 is composed of sodium chloride as its key ingredient which enables the freezing point of the solution to be lowered to below 32° Fahrenheit. Preferably, the brine 46 has at least about 5% sodium chloride by weight. Typically, the brine solution will contain between about 4% and about 10% sodium chloride by weight. At least a portion of the remainder of the brine 46 is made up of water. If calcium chloride is used to make the brine coolant solution, the brine coolant solution preferably has at least about 5% calcium chloride and about 15% calcium chloride by weight.

If a brine solution 46 is used, it is cooled to a temperature lower than 32° Fahrenheit and can be cooled as low as about 20° Fahrenheit. Typically, it is anticipated that the brine solution 46 will be cooled to a temperature of between about 20° Fahrenheit and about 27° Fahrenheit before it is applied on pouches 34 on the conveyor 30 to cool food product 32 in the pouches 34 to a temperature below 50° Fahrenheit and as low as 40° Fahrenheit or lower, depending upon coolant flow rates and discharge pressures.

Preferably, depending upon the temperature of the coolant 46, its cooling capacity, the length of the conveyor 30, the nature and efficiency of the mode of heat transfer between the pouch 34, food product 32 and coolant 46, the cooling conveyor 30 of this invention can cool pouched food product 32 to a temperature as low as 33° Fahrenheit, if desired. In some cases, where glycol coolant is used, pouched food product 32 can even be frozen.

FIGS. 7–11 show in more detail some typical pouch embodiments 34 for which the method of this invention is intended. These pouches 34 typically are constructed of a substantially continuous flexible laminate sidewall 36 having one or more layers comprised of a polymer, plastic, or elastomer all selected to impart a particular property or set of particular properties to the pouch 34. At least one of the layers of the pouch sidewall 36 is comprised of nylon, polyethylene such as low linear density polyethylene (LLDPE), polypropylene, polyethylene terephalate (PET), ethylene vinyl acetate (EVA), polyvinyl chloride coated (PVDC), a copolymer film, or oriented polypropylene (OPP), with at least one or more of the aforementioned layers becoming increasingly more brittle as its temperature drops below 50° Fahrenheit during cooling. These pouches 34 are constructed to hold food product 32 in a sealed environment such that its food product contents will not leak out and fluid outside the pouch 34 will not migrate into the pouch 34. The pouches 34 are durable in that they are constructed to withstand the heat of blanching which can result in the pouches being exposed to temperatures as high as 212° Fahrenheit. Food product 32 typically sealed within these pouches 34 during food processing include soups, sauces, pasta, vegetables, juices, fruits, meats, salad dressings, condiments, and other types of food products such as poultry and seafood. It should also be noted that the method and conveyor of this invention is also well suited for cooling pouches 34 of like construction holding material or a product that does not constitute a food product.

Figure 7:
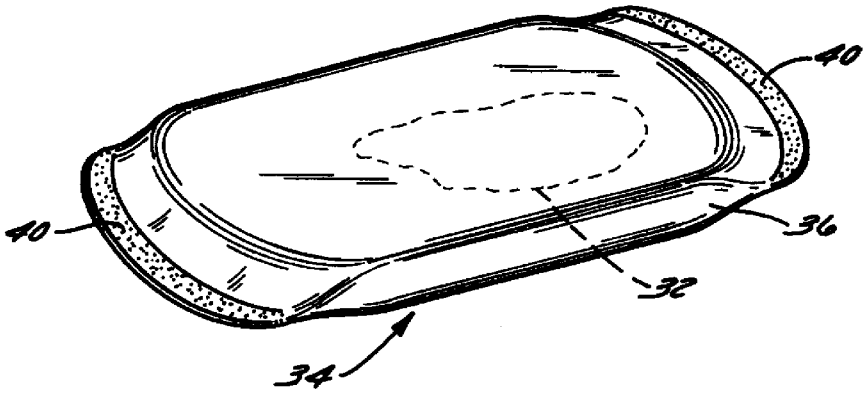
FIG. 7 is an enlarged perspective view of a pouch.

Referring to FIG. 7, each pouch 34 typically is elongate and hollow inside for receiving food product 32 (in phantom in FIG. 7) therein and has a seal 40 at least at one end to retain the food product 32 in an airtight environment. The pouch 34 shown in FIG. 7 has a seal 40 at both ends. Typically, the seal 40 is a heat seal 40. In some instances, pouches 34 comprise a hollow flexible synthetic casing sealed using clips, metal fasteners or plastic fasteners.

Figure 8:
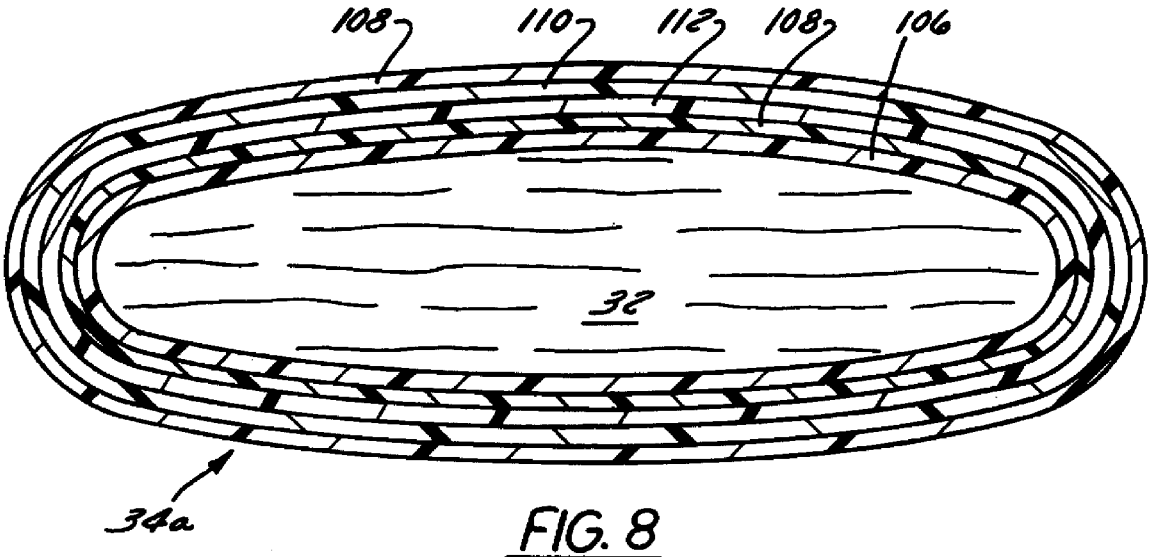
FIG. 8 is an enlarged cross sectional view of a pouch showing its laminated or layered sidewall construction.

FIGS. 8–11 depict the cross section of several typical pouch embodiments 34*a*–34*d* with the thickness of the laminate sidewall layers exaggerated for clarity. FIG. 8 depicts a pouch 34*a* commonly used for processing bulk liquids, such as soups, salad dressings, sauces and the like. The pouch 34*a* has an inner layer of LLDPE 106 having a thickness of about 2.25 mil, a 60 gauge thickness layer of bias nylon 108 joined by an adhesive (not shown) to the LLDPE 106 and a 72 gauge thickness layer of PVDC 110 coated on its exterior with bias nylon 108 adhered to the interior bias nylon layer. If desired, the pouch 34*a* can have a layer of print 112 between the PVDC 110 and interior nylon layer 108. The pouch 34*a* shown in FIG. 8 is representative of a pouch 34*a* commercially known as a LIQUI-FLEX 9201 protective packaging film stand pouch for bulk liquids manufactured by Curwood Incorporated of 2200 Badger Avenue, Oshkosh, Wis., United States of America.

Figure 9:
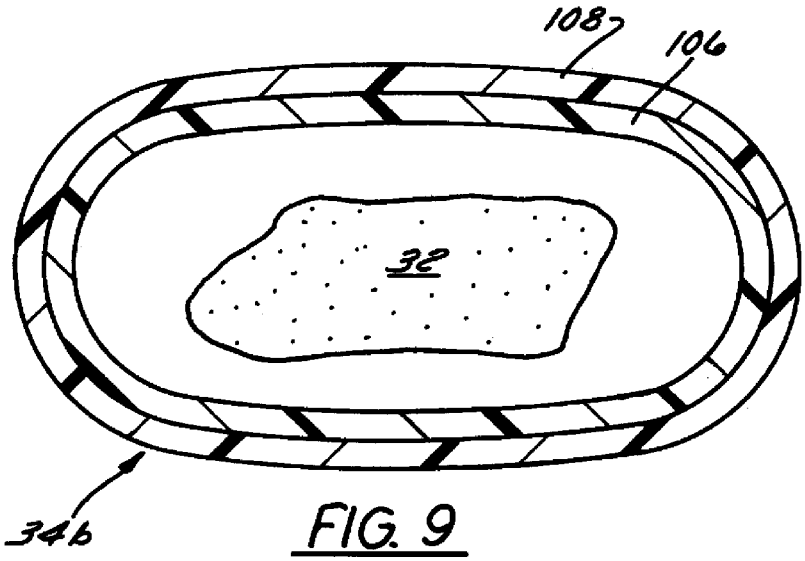
FIG. 9 is an enlarged cross sectional view of another pouch embodiment.
Figure 10:
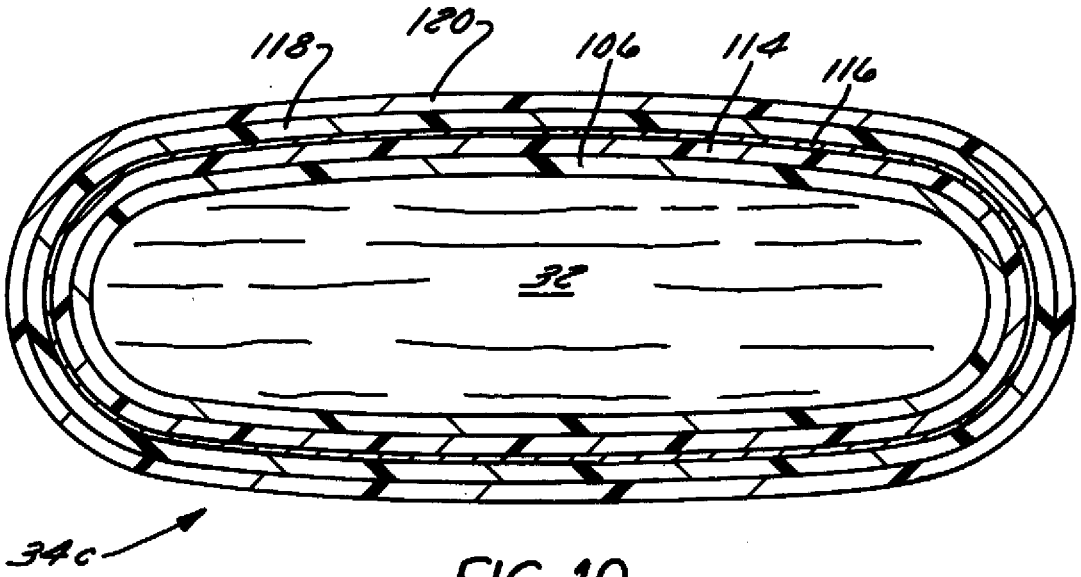
FIG. 10 is an enlarged cross sectional view of a still further pouch embodiment.

FIG. 9 depicts another typical pouch embodiment 34*b* having an inner layer of LLDPE 106 of about two mil thickness adhered to a layer of one-hundred gauge thickness bias nylon 108 for food processing applications which can result in the boiling of the food product 32 while within the pouch 34*b*. FIG. 10 depicts a still further typical pouch embodiment 34*c* having (1) an inner layer 106 of LLDPE 0.0015 inch thick, (2) a 9# layer of EVA laminate 114, (3) a thin layer of metal foil 116 (0.000285 inches thick), (4) a 9# layer of white laminate 118, (5) and a 35 gauge thick outer layer of PET 120 for constructing a flexible pouch 34*c* well suited for one to three ounce single service salad dressing and condiment applications. If desired, the pouch 34*c* can have a printed layer (not shown) between the white laminate layer 118 and outer PET layer 120. FIG. 11 illustrates a pouch embodiment 34*d* having an inner layer of EVA 114 (19#), a layer of foil 116 (0.000285 inch thick), a layer of white laminate 118 (9#) and a 50 gauge thick outer layer of OPP 122. The pouch 34*d* can have a printed or ink layer 112 between the OPP 122 and white laminate 118, if desired.

In operation, pouches 34 like those shown in FIGS. 7–11 and described above are each at least partially filled with food product 32 and airtightly sealed before being processed by heating each pouch 34 to heat food product 32 within. Typically, heating is accomplished in a blancher food processing apparatus which heats each pouch 34, and food product 32 within each pouch 34, by at least partial immersion in a tank of heated liquid. After heating is completed, the pouches 34 inside the blancher can be directly transferred from the blancher to the cooling conveyor 30, if desired.

Figure 4:
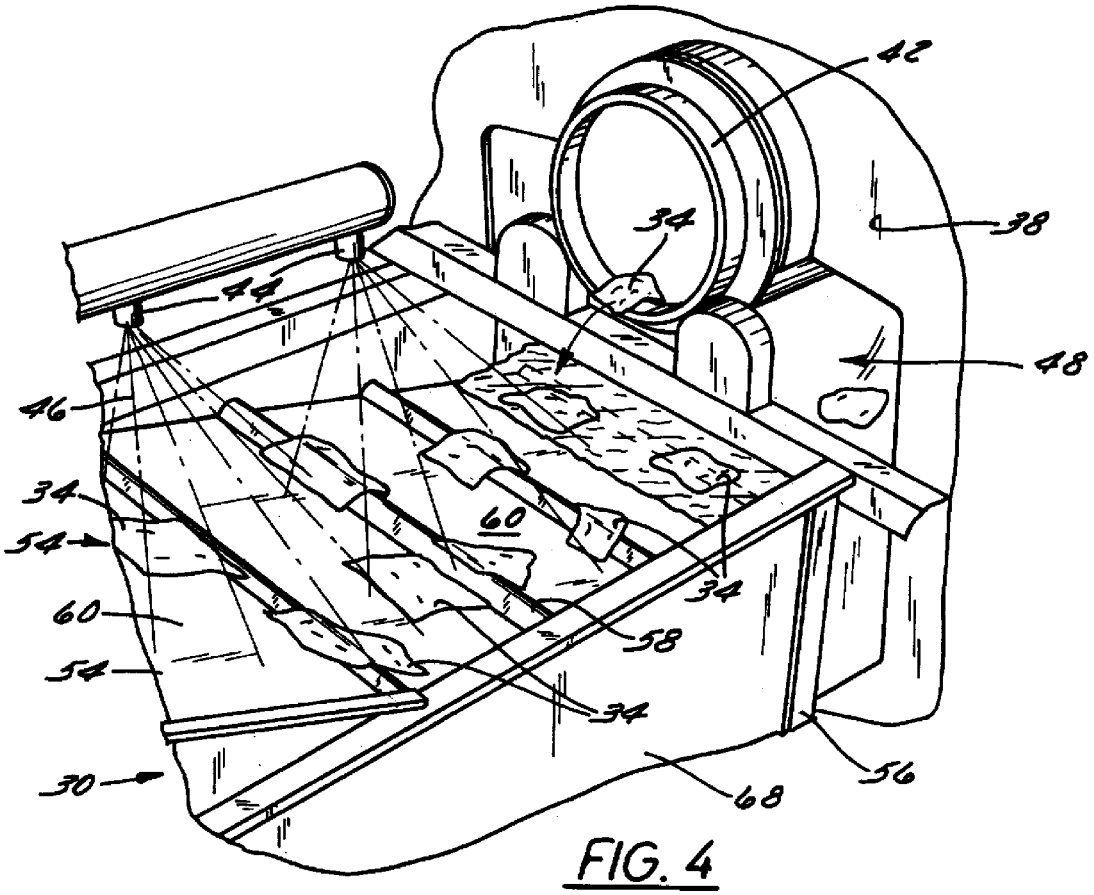
FIG. 4 is an enlarged fragmentary perspective view of the outlet of the food processing apparatus and conveyor with its inlet end in line with the apparatus discharge outlet.

Preferably, after blanching the heated pouches 34 and food product 32 are precooled in a chiller-type food processing apparatus 38, such as the food product chiller 38 shown in FIGS. 1 and 4. After precooling the pouches 34 and food product 32 within each pouch 34, typically to a temperature of between about 60° Fahrenheit and about 45° Fahrenheit, the pouches 34 are transferred onto the cooling conveyor 30 to be further cooled to an even lower temperature.

FIG. 4 illustrates pouches 34 being discharged from the outlet 42 of the food product chiller 38 onto the conveyor belt 60 adjacent the inlet end 48 of the conveyor 30. As the belt 60 moves, it carries the pouches 34 from adjacent the inlet end 48 toward the outlet end 50. As the pouches 34 travel along the conveyor 30, coolant 46, having a freezing point temperature of less than 32° Fahrenheit, is showered on the pouches 34 cooling the food product 32 within each pouch 34. Coolant 46 draining from the conveyor bed 52 and belt 60 is collected below in the catch basin 72 where it is thereafter transferred to the coolant chiller 86 to be recooled for reuse. After recooling, the coolant 46 is pumped from the coolant chiller 86 to the coolant conduit 102 where it is expelled under pressure from the nozzles or orifices 44 onto other pouches 34 traveling along on the conveyor 30, cooling the pouches 34 and the food product 32 within each pouch 34 continuously.

It is also to be understood that, although the foregoing description and drawings describe and illustrate in detail one or more embodiments of the present invention, to those skilled in the art to which the present invention relates, the present disclosure will suggest many modifications and constructions as well as widely differing embodiments and applications without thereby departing from the spirit and scope of the invention. The present invention, therefore, is intended to be limited only by the scope of the appended claims.

What is claimed is:

1. A method of cooling food product in pouches comprising:

(a) providing a plurality of flexible synthetic pouches each holding food product; a conveyor having a frame with an inlet end and an outlet end, means for urging pouches toward the outlet end, a plurality of spaced apart orifices for delivering coolant onto the pouches as they are being urged toward the outlet end, and a source of a coolant having a freezing point below 32° Fahrenheit;

(b) cooling the coolant below 32° Fahrenheit;

(c) loading food product-containing pouches onto the conveyor;

(d) urging the pouches toward the conveyor outlet; and (e) discharging coolant from the orifices onto the pouches for cooling food product in the pouches to a temperature below 50° Fahrenheit.

2. The method of claim 1 wherein each pouch is comprised of a flexible laminate material having at least one laminate layer comprised of one of the following materials: nylon, polypropylene, polyethylene, low linear density polyethylene, white laminate, polyethylene terephalate, a copolymer film, ethylene vinyl acetate, and oriented polypropylene.

3. The method of claim 2 wherein the coolant comprises an ethylene glycol solution cooled during step (b) to a temperature of between minus 10° Fahrenheit and about 20° Fahrenheit before being discharged through the orifices onto the pouches.

4. The method of claim 3 wherein the ethylene glycol coolant solution is comprised of at least 10% ethylene glycol by weight.

5. The method of claim 4 wherein the ethylene glycol coolant solution is comprised of no greater than 50% ethylene glycol by weight.

6. The method of claim 4 wherein the ethylene glycol coolant solution is comprised of at least 40% ethylene glycol by weight for imparting to the coolant sufficient cooling capacity to cool food product in each pouch below 50° Fahrenheit.

7. The method of claim 6 wherein during step (e) coolant at a flow rate of at least three gallons per minute is discharged from each orifice onto pouches to provide sufficient coolant to cool food product in each pouch to a temperature below 50° Fahrenheit.

8. The method of claim 6 wherein during step (e) coolant at a pressure of at least ten pounds per square inch is discharged from each orifice onto pouches to cool food product in each pouch to a temperature below 50° Fahrenheit.

9. The method of claim 6 wherein during step (e) coolant at a temperature of between zero degrees Fahrenheit and minus ten degrees Fahrenheit is discharged from each orifice onto pouches to cool food product in each pouch to a temperature below 32° Fahrenheit.

10. The method of claim 2 wherein the coolant comprises a brine solution cooled during step (b) to a temperature of between 20° Fahrenheit and 27° Fahrenheit before being discharged through the orifices onto the pouches.

11. The method of claim 10 wherein the brine coolant solution comprises at least 10% brine by weight.

12. The method of claim 11 wherein the brine coolant solution comprises between 4% and 10% sodium chloride by weight.

13. The method of claim 11 wherein the brine coolant solution comprises between 5% and 15% calcium chloride by weight.

14. The method of claim 11 wherein during step (e) coolant at a flow rate of at least three gallons per minute is discharged from each orifice onto pouches to provide sufficient coolant to cool food product in each pouch to a temperature below 50° Fahrenheit.

15. The method of claim 11 wherein during step (e) coolant at a pressure of at least ten pounds per square inch is discharged from each orifice onto pouches to cool food product in each pouch to a temperature below 50° Fahrenheit.

16. The method of claim 1 wherein the coolant is an ethylene glycol solution containing at least 40% ethylene glycol by volume and cooled to a temperature of less than about 10° Fahrenheit and during step (e) coolant is discharged from each orifice onto the pouches at a flow rate of at least three gallons per minute and at a pressure of at least ten pounds per square inch to cool food product in the pouches to a temperature of 35° Fahrenheit or colder.

17. The method of claim 16 wherein each pouch is comprised of a flexible laminate material having at least one laminate layer comprised of nylon.

18. The method of claim 16 wherein each pouch is comprised of a flexible laminate material having at least one laminate layer comprised of a polypropylene.

19. The method of claim 16 wherein each pouch is comprised of a flexible laminate material having at least one laminate layer comprised of a copolymer film.

20. The method of claim 16 wherein each pouch is comprised of a flexible laminate material having at least one laminate layer comprised ethylene vinyl acetate.

21. The method of claim 1 wherein the coolant is an brine solution containing at least 10% brine by weight that is cooled to a temperature of less than about 27° Fahrenheit and during step (e) coolant is discharged from each orifice onto the pouches at a flow rate of at least three gallons per minute and at a pressure of at least ten pounds per square inch to cool food product in the pouches to a temperature of 40° Fahrenheit or colder.

22. A method of cooling food product in pouches comprising:

(a) providing a plurality of flexible synthetic pouches each holding food product; a conveyor having an outlet for conveying pouches each containing food product toward the outlet, a plurality of spaced apart orifices for delivering coolant onto pouches on the conveyor and a source of ethylene glycol coolant solution;

(b) cooling the ethylene coolant solution to a temperature less than about 20° Fahrenheit;

(c) loading food product-containing pouches onto the conveyor;

(d) conveying the pouches toward the conveyor outlet; and (e) discharging coolant from the orifices onto the pouches for cooling food product in the pouches to a temperature less than 50° Fahrenheit.

23. A method of cooling food product in pouches comprising:

(a) providing a plurality of flexible synthetic pouches each holding food product; a conveyor having an outlet for conveying pouches each containing food product toward the outlet, a plurality of spaced apart orifices for delivering coolant onto pouches on the conveyor and a source of brine coolant solution;

(b) cooling the brine coolant solution to a temperature less than about 27° Fahrenheit;

(c) loading food product-containing pouches onto the conveyor;

(d) conveying the pouches toward the conveyor outlet; and (e) discharging coolant from the orifices onto the pouches for cooling food product in the pouches to a temperature below 50° Fahrenheit.

24. The method of claim 23 wherein the brine coolant solution is comprised of sodium chloride and water.

25. The method of claim 23 wherein the brine coolant solution is comprised of calcium chloride and water.

26. A method of cooling food product in pouches without agitation, massaging or physical manipulation of the pouches to enhance cooling comprising:

(a) providing a plurality of flexible synthetic pouches each holding food product; a conveyor having an outlet for conveying pouches each containing food product toward the outlet, a plurality of spaced apart orifices for delivering coolant onto pouches on the conveyor and a source of liquid coolant;

(b) cooling the coolant solution to a temperature less than 32° Fahrenheit;

(c) loading food product-containing pouches onto the conveyor;

(d) conveying the pouches toward the conveyor outlet;

(e) discharging coolant from the orifices onto the pouches for cooling food product in the pouches to a temperature less than 50° Fahrenheit.

* * * * *